US007370990B2

(12) United States Patent
Juřík

(10) Patent No.: US 7,370,990 B2
(45) Date of Patent: May 13, 2008

(54) EQUIPMENT FOR A CHANGE OF ROTARY GOBOS

(76) Inventor: Pavel Juřík, Prostřední Bečva 543, 75656 Prostřední Bečva (CZ)

( * ) Notice: Subject to any disclaimer, the term of this patent is extended or adjusted under 35 U.S.C. 154(b) by 0 days.

(21) Appl. No.: 10/534,927

(22) PCT Filed: Nov. 13, 2003

(86) PCT No.: PCT/CZ03/00067

§ 371 (c)(1),
(2), (4) Date: Aug. 24, 2005

(87) PCT Pub. No.: WO2004/046607

PCT Pub. Date: Jun. 3, 2004

(65) Prior Publication Data

US 2006/0011021 A1 Jan. 19, 2006

(30) Foreign Application Priority Data

Nov. 15, 2002 (CZ) ..... PV-2002-3792

(51) Int. Cl.
*F21V 9/10* (2006.01)

(52) U.S. Cl. ..... 362/227; 362/269; 362/280; 362/282; 362/293; 362/323

(58) Field of Classification Search ..... 362/227, 362/269, 277, 280, 282, 293, 322, 323; 353/97, 353/84, 108, 110, 120; 359/813, 814, 889, 359/821, 822
See application file for complete search history.

(56) References Cited

U.S. PATENT DOCUMENTS

| | | | | |
|---|---|---|---|---|
| 4,037,097 | A | 7/1977 | Stillman et al. | |
| 5,402,326 | A * | 3/1995 | Belliveau | 362/284 |
| 6,402,344 | B1 | 6/2002 | Palazzo | |
| 6,601,973 | B2 * | 8/2003 | Rasmussen et al. | 362/282 |
| 2002/0075645 | A1 | 6/2002 | Rasmussen et al. | |

FOREIGN PATENT DOCUMENTS

| | | |
|---|---|---|
| DE | 22 63 689 | 7/1974 |

* cited by examiner

*Primary Examiner*—Sharon E. Payne

(57) ABSTRACT

For lighting equipment for illumination of theatre and show stages and platforms there is designed an equipment for change of rotary gobos comprising a carrier disc supporting interchangeable segments with the gobos. The individual segments (2) are attached at the carrier disc (1) by central holding means, each segment (2) being provided with means for setting the segment (2) on the carrier disc (1). Each segment (2) is provided with a lamella (3) for attachment in the central holding mean holding means comprise a system of flexible fingers (10) in a fan-shaped arrangement, the fingers (10) being at inside ends fixed to the carrier disc (1) and on the outside free ends adapted to allow for insertion of the segment lamellas (3) between the fingers (10) and the carrier disc (1).

4 Claims, 3 Drawing Sheets

EQUIPMENT FOR A CHANGE OF ROTARY GOBOS

TECHNICAL FIELD

The invention relates to an equipment for a change of rotary gobos furnished with a carrier disc supporting interchangeable segments with the gobos,

BACKGROUND OF THE INVENTION

The expression gobo relates to an image which is to be projected as a slide within a comparatively great distance. Due to a high temperature of the respective light source such an image is created on a metal, glass or any suitable base. To increase the achieved effect the gobos rotate, as moving image attracts more attention. Rotary gobos need not to rotate continuously, therefore their rotation depends upon activation of a drive motor. Generally speaking there exist two basic types of rotary gobo systems, which are applied with minor or major divergences. By the first system gobos are placed on a carrier disc and the gobos are interchanged. Such a system is technologically simple and cheap, but from a practical point of view it is very uncomfortable. In general a lighting equipment offer very little space for any manipulation and often special tools are necessary. This simple design is used preferably for cheap equipment. By the second system the carrier disc is furnished with mutually independent segments, one segment for each gobo, and there are changed complete segments. In most cases each segment has a special bearing with grooves matching with counterpieces on the carrier disc. This design is very demanding on manufacture technology. It is an object of the invention to simplify the design of attachment of gobos at the carrier disc and to facilitate the change procedure.

DISCLOSURE AND OBJECT OF THE INVENTION

The foregoing problems are solved by an equipment for a change of rotary gobos comprising a carrier disc supporting interchangeable segments with the gobos in accordance with the present invention the individual segments being attached at the carrier disc by central holding means, each segment being provided with means for setting the segment on the carrier disc. Further in accordance with the present invention each segment may be provided with a lamella for attachment in the central holding means. In a preferred embodiment the central holding means comprise a system of flexible fingers in a fan-shaped arrangement. The fingers are at inside ends fixed to the carrier disc and on the outside free ends adapted to allow for insertion of the segment lamellas between the fingers and the carrier disc. The fingers may be at their inside ends integrated into one unit. The number of fingers within the unit corresponds to a number of segments to be supported by the carrier disc. Still further in accordance with the invention each segment is provided with a bearing supporting a driver with a gobo. The bearing inside ring is provided for by the driver outer rim and the bearing outside ring is attached to the segment lamella by dismountable connection means. The driver further comprise a flange with a spur toothing, designed for engaging with a mechanism for rotation of the gobos. Dismountable connection means for attachment of the bearing outer ring on the lamella may be preferably utilised as means for setting the segment on the carrier disc. The carrier disc may be further provided with circular apertures allowing for lighting of gobos, the apertures having their centres located at a common pitch circle and being along own perimeter provided with means for engaging with means for setting the segments on the carrier disc.

According the first aspect of the invention there is provided a simple seating of a segment with gobos on the carries disc and changing of the gobos is a very simple and easy procedure. According to another aspect of the invention the presented solution is also technologically simple with little manufacturing costs.

BRIEF DESCRIPTION OF THE DRAWINGS

By way of examples the invention will be now described with reference to the accompanying drawing. On FIG. 1 there is presented an axonometric view from above on a carrier disc with seven segments, one of which is in an outside position and FIG. 2 show and an axonometric view from underneath on the carrier disc according to FIG. 1.

DESCRIPTION OF PREFERRED EMBODIMENTS

Figure 1:
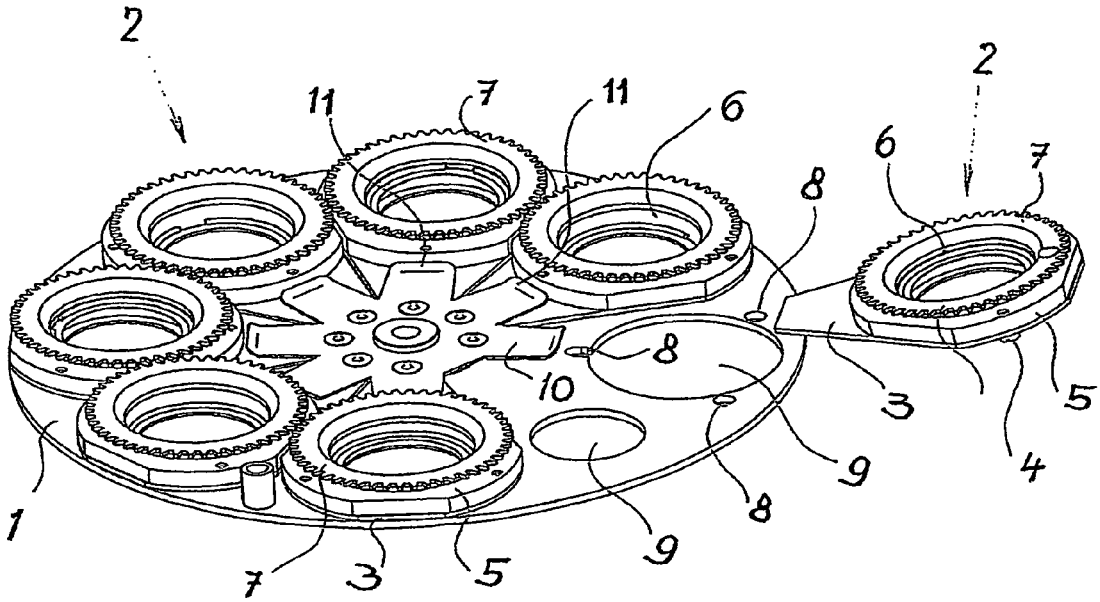

Referring to FIG. 1, there is shown an equipment for a change of rotary gobos comprising a carrier disc 1 on which there are arranged interchangeable segments 2 with gobos. On all accompanying drawings gobos are presented simply as blank fields. In the embodiment presented on FIG. 1 the carrier disc 1 is equipped with seven segments 2 and one free position, which serves for direct illumination by white, non-colour light.

All segments 2 are by central holding means attached at the carrier disc 1. Basic part of each segment 2 is made of a shaped lamella 3, the free part of which serves for attachment of the segment 2 in the central holding means. The gobo is fixed in a driver 6 seating in ball bearing. Dismountable connection means, like screws 4 with cylindrical head in the depicted embodiment, serve for securing a ball bearing outside ring 5 on the lamella 3 of each segment 2. The bearing balls are freely located in the bearing outside ring 5, while the bearing inside ring is provided for by a driver 6 outer rim. The driver 6 seating is thus of a very simple design when compared with a standard ball bearing arrangement, nevertheless the function of a rotary gobo is fully retained. The driver 6 is provided with a flange Z having a spur toothing for engagement with a mechanism for rotation of the gobos.

The carrier disc 1 is provided with apertures 9, the centers of which are placed on a common pitch circle. The apertures 9 allow for a light beam to go through the gobos or just through the carrier disc 1, as the case may be.

Figure 2:
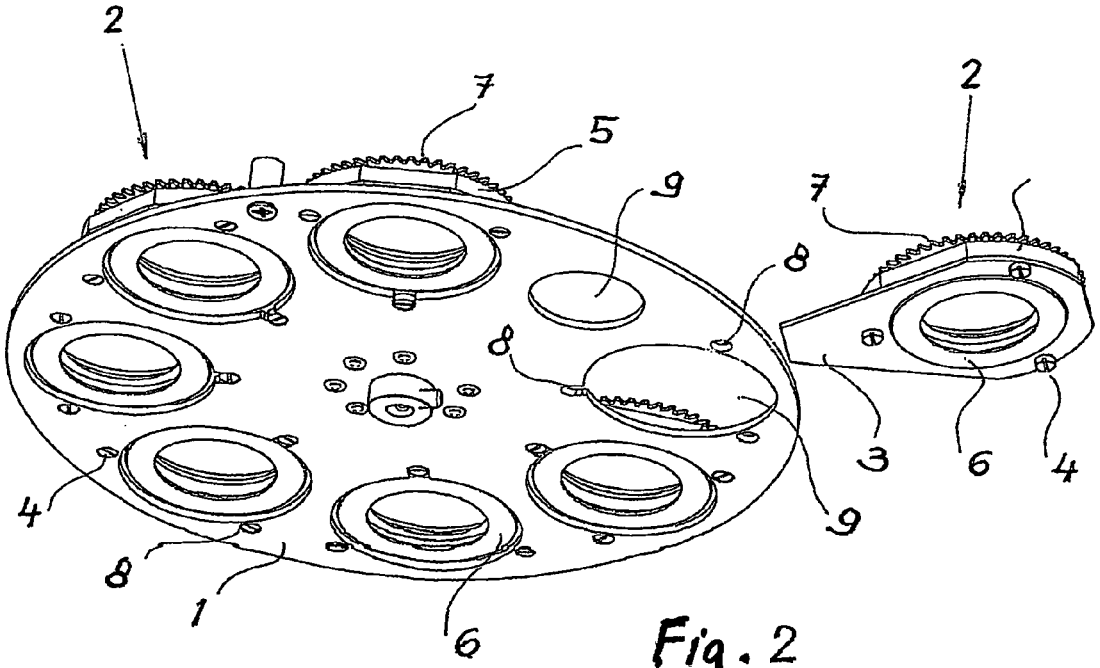
Figure 3:
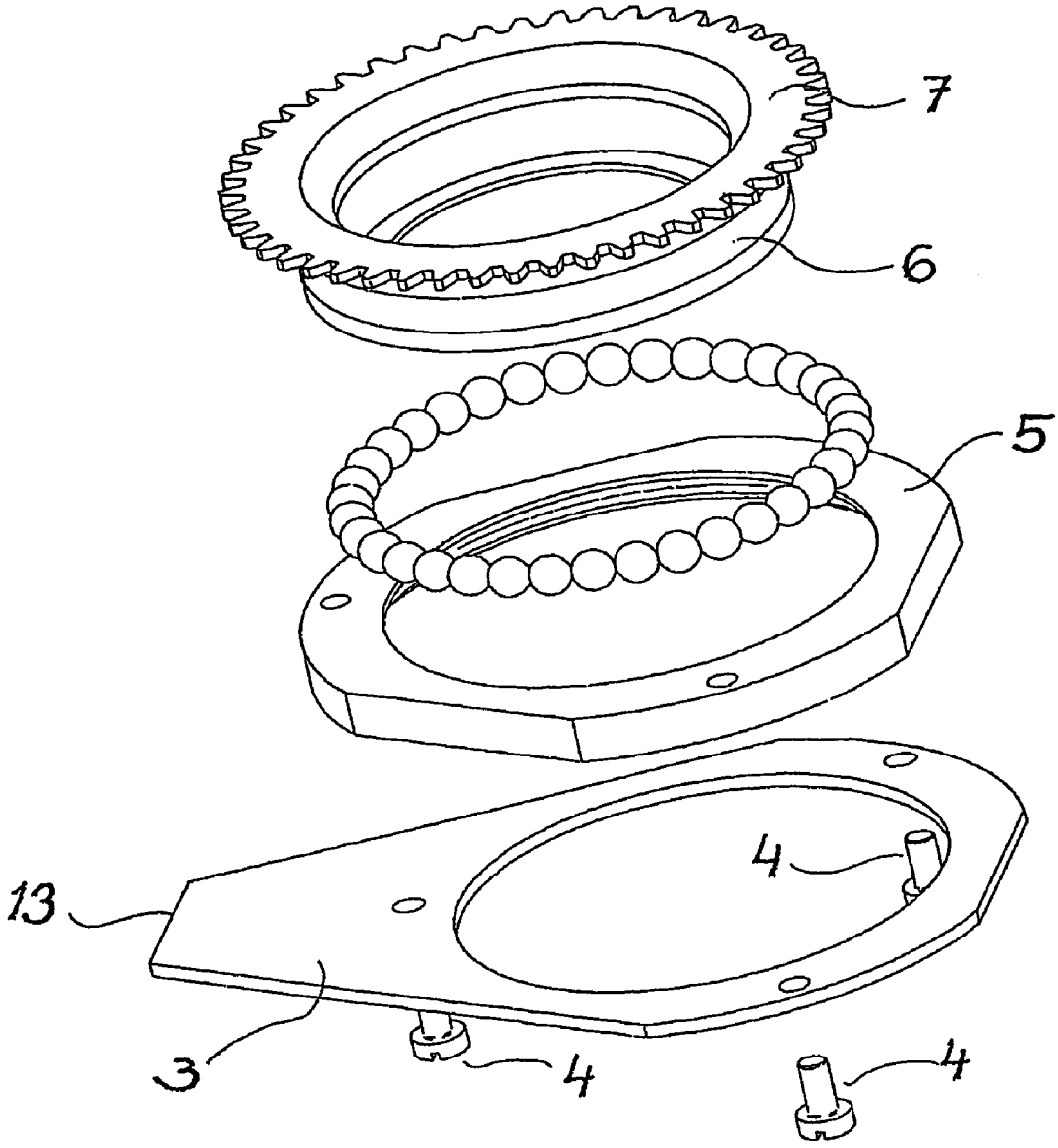
FIG. 3 is an axonometric view on one segment in a disassembled state.

Each segment 2 is provided with means for setting a segment 2 on the carrier disc 1. Preferably the means for setting a segment 2 on the carrier disc 1 are provided for by the dismountable connection means for attachment of a ball bearing outside ring 5 on the lamella 3. In the discussed embodiment the means for setting a segment 2 on the carrier disc 1 are provided for by the cylindrical heads of the screws 4. To achieve a proper position of the segment 2 on the carrier disc 1 the screw 4 heads match with recesses 8 made along a perimeter of respective aperture 9 in the carrier disc 1. In the embodiment shown on FIG. 1 and FIG. 2 there are used three screws 4 for each segment 2 and therefore each aperture 9 has three recesses 8 distributed along its perimeter and spaced apart with respect to distribution of the screws 4. There may be used a different number of the screws 4, but basically two of them are sufficient. Instead of the above described construction the means for setting a segment 2 on the carrier disc 1 may be provided for also by another means known as such.

Figure 4:
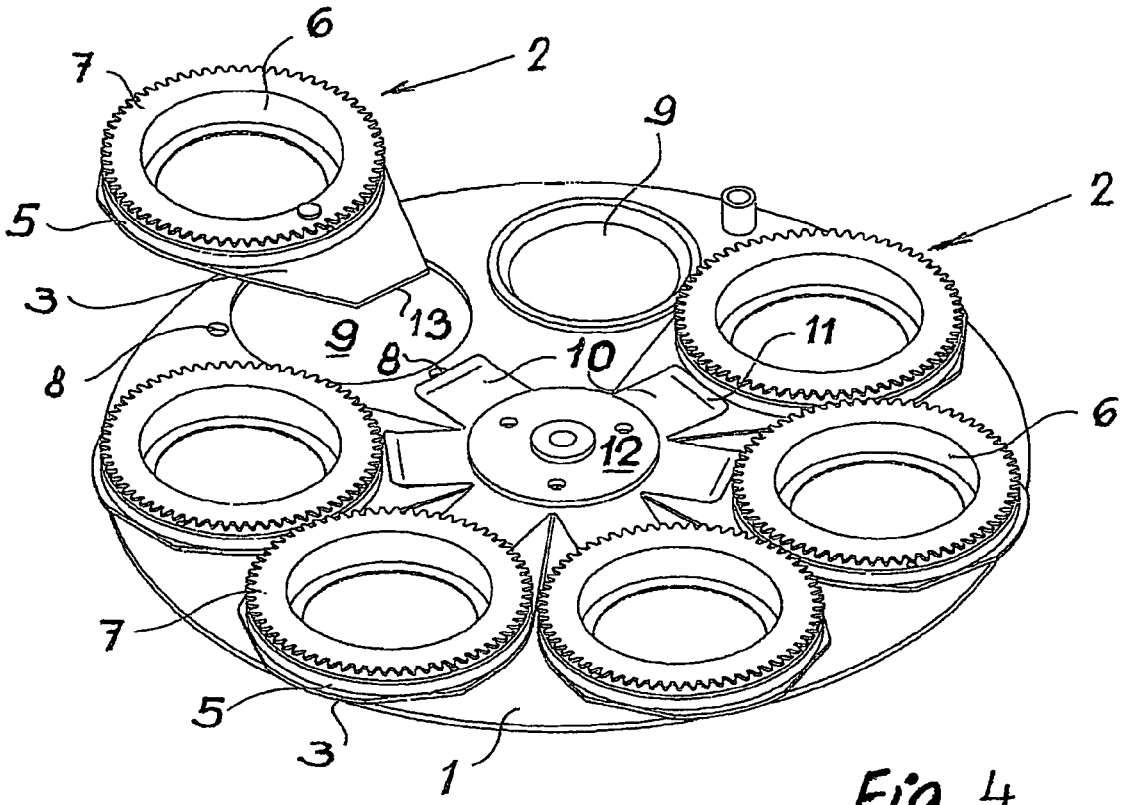
FIG. 4 presents an axonometric view on a carrier disc supporting six segments and FIG. 5 represents an axonometric view on a carrier disc with five segments.
Figure 5:
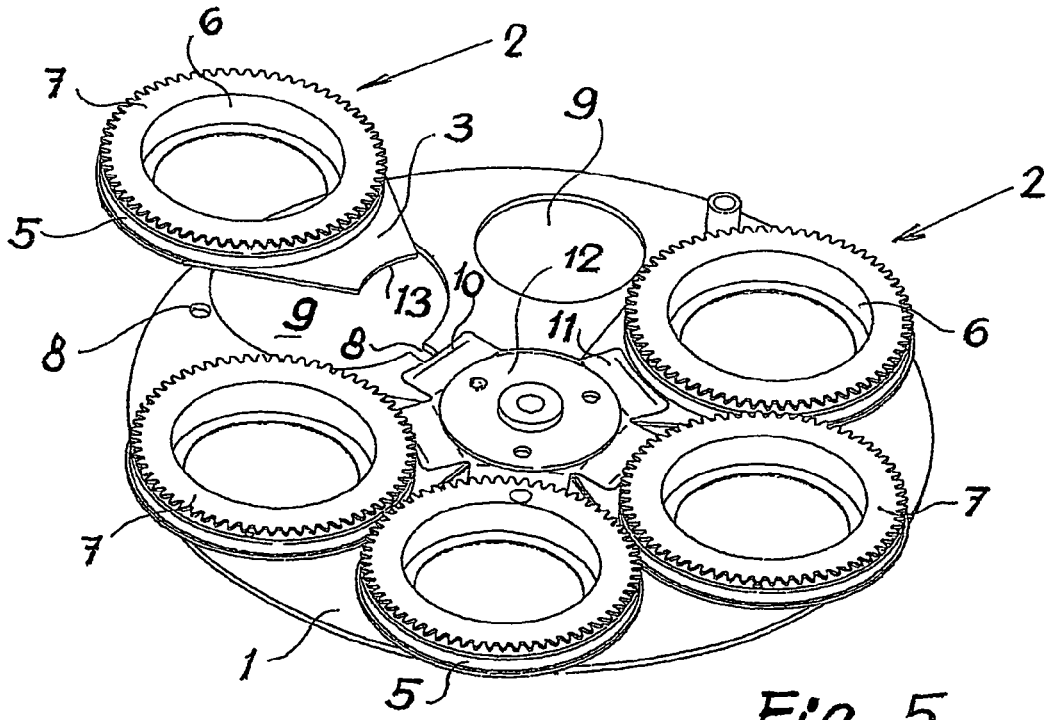

The central holding means comprise a system of radially extending flexible fingers 10 in a fan-shaped arrangement. The fingers 10 are at inside ends attached to the carrier disc 1, preferably by rivets, and on the outside free ends 11 bent upwards to facilitate insertion of segment lamellas 3 between the fingers 10 and the carrier disc 1 body. Number of fingers 10 corresponds to the number of the segments 2, but it is possible for one finger 10 to secure position of more than one segment 2. Preferably the inside ends of all the fingers 10 are integrated into one piece. In a place corresponding to a free position on the carrier disc 1 there is no finger 10 and the space is kept free. To improve pressing forces produced by the central holding means upon the segment 2 lamellas 3 the fingers 10 may be provided with a pressure disc 12 located in their central part common for all the fingers 10, as presented on FIGS. 4 and 5.

To further facilitate insertion of the segment lamella 3 under the finger 10 of the carrier disc 1 one of the recesses 8 is carried out in such a way, that a centre of such a recess 8 is located at a radial going through the carrier disc 1 centre, as it is performed by the embodiments illustrated on FIGS. 1, 2, 4 and 5. By a larger number of segments 2, usually seven and more, the driver 6 outside contour edges are cut off, as shown on FIGS. 1 and 2. By a small number of the segments 2, the inside edge 13 of the lamella 3 is of an arc shape for a better fit under the central holding means.

INDUSTRIAL APPLICATIONS

The present invention is designed for lighting equipment, especially for illumination of theatre and show stages and platforms etc.

The invention claimed is:

1. Equipment for a change of rotary gobos comprising a carrier disc provided with circular apertures allowing for lighting of gobos and furnished with a flexible holder to removably secure interchangeable segments with the gobos to the carrier disc, wherein each segment is provided with a lamella to be held by the holder and with a setting portion to fix the position of the segment on the carrier disc, wherein each segment is provide with a bearing supporting a driver with a gobo, wherein a bearing inside ring is provided by a driver outer rim, and a bearing outside ring is attached to the segment lamella by a dismountable-connection, while the driver comprises a flange with a spur toothing.

2. Equipment for a change of rotary gobos comprising a carrier disc provided with circular apertures allowing for lighting of gobos and furnished with a flexible holder to removably secure interchangeable segments with the gobos to the carrier disc, wherein each segment is provided with a lamella to be received and held by the holder and with a setting portion to position the segment on the carrier disc, wherein the setting portion for positioning the segment on the carrier disc comprises a dismountable-connection for attachment of the gobo bearing outer ring on the lamella.

3. Equipment for a change of rotary gobos according to claim 1 or claim 2, wherein the holder comprises a system of flexible fingers in a fan shaped arrangement, the fingers being at inside ends fixed to the carrier disc, and on the outside free ends is adapted to allow for insertion of the segment lamellas between the fingers and the carrier disc.

4. Equipment for a change of rotary gobos according to claim 3, wherein inside ends of the fingers are integrated into one unit, while the number of fingers within this unit corresponds to the number of segments to be supported by the carrier disc.

* * * * *